US010201255B2

(12) United States Patent
Brants

(10) Patent No.: US 10,201,255 B2
(45) Date of Patent: Feb. 12, 2019

(54) APPARATUS FOR TOILET PAPER SPRITZER

(71) Applicant: Frank C. Brants, Fort Worth, TX (US)

(72) Inventor: Frank C. Brants, Fort Worth, TX (US)

( * ) Notice: Subject to any disclaimer, the term of this patent is extended or adjusted under 35 U.S.C. 154(b) by 289 days.

(21) Appl. No.: 15/042,114

(22) Filed: Feb. 11, 2016

(65) Prior Publication Data

US 2016/0309969 A1 Oct. 27, 2016

Related U.S. Application Data

(60) Provisional application No. 62/116,261, filed on Feb. 13, 2015.

(51) Int. Cl.
*A47K 10/32* (2006.01)
*A47K 10/38* (2006.01)

(52) U.S. Cl.
CPC ..... *A47K 10/38* (2013.01); *A47K 2010/328* (2013.01)

(58) Field of Classification Search
CPC ..... A47K 2010/328
See application file for complete search history.

(56) References Cited

U.S. PATENT DOCUMENTS

| | | | | | |
|---|---|---|---|---|---|
| 1,920,867 | A * | 8/1933 | Kirk | B65D 35/40 | 222/256 |
| 3,495,571 | A * | 2/1970 | Evans | A47K 10/32 | 118/325 |
| 3,865,271 | A * | 2/1975 | Gold | A47K 10/32 | 221/96 |
| 5,435,465 | A * | 7/1995 | El-Amin | A47K 5/1204 | 222/108 |
| 5,887,759 | A * | 3/1999 | Ayigbe | A47K 10/32 | 118/325 |
| 2003/0052136 | A1* | 3/2003 | Weng | A47K 10/32 | 222/192 |
| 2009/0090737 | A1* | 4/2009 | Franco | A47K 5/12 | 221/96 |
| 2015/0272404 | A1* | 10/2015 | Jeon | A47K 10/32 | 222/173 |

* cited by examiner

*Primary Examiner* — Charles Capozzi
(74) *Attorney, Agent, or Firm* — Lee & Hayes, P.C.

(57) ABSTRACT

An apparatus for a toilet paper spritzer that is a scalable dispensing device for use with other components, such as toilet paper or paper towels and any fluid, such as water, witch hazel, scented fluids, medicated fluids, colored fluids, to improve hygiene, comfort, prevent or treat symptoms of genital and anal medical conditions, such as hemorrhoids, yeast infection, and the like. The toilet paper spritzer comprises a fluid dispensing chamber with a pump activation system for dispensing fluid onto toilet paper prior to use. The spritzer device can comprise a toilet paper holder. The pump activation system within the toilet paper spritzer can be manually activated, or automatically activated using solar and/or battery powered technology.

18 Claims, 9 Drawing Sheets

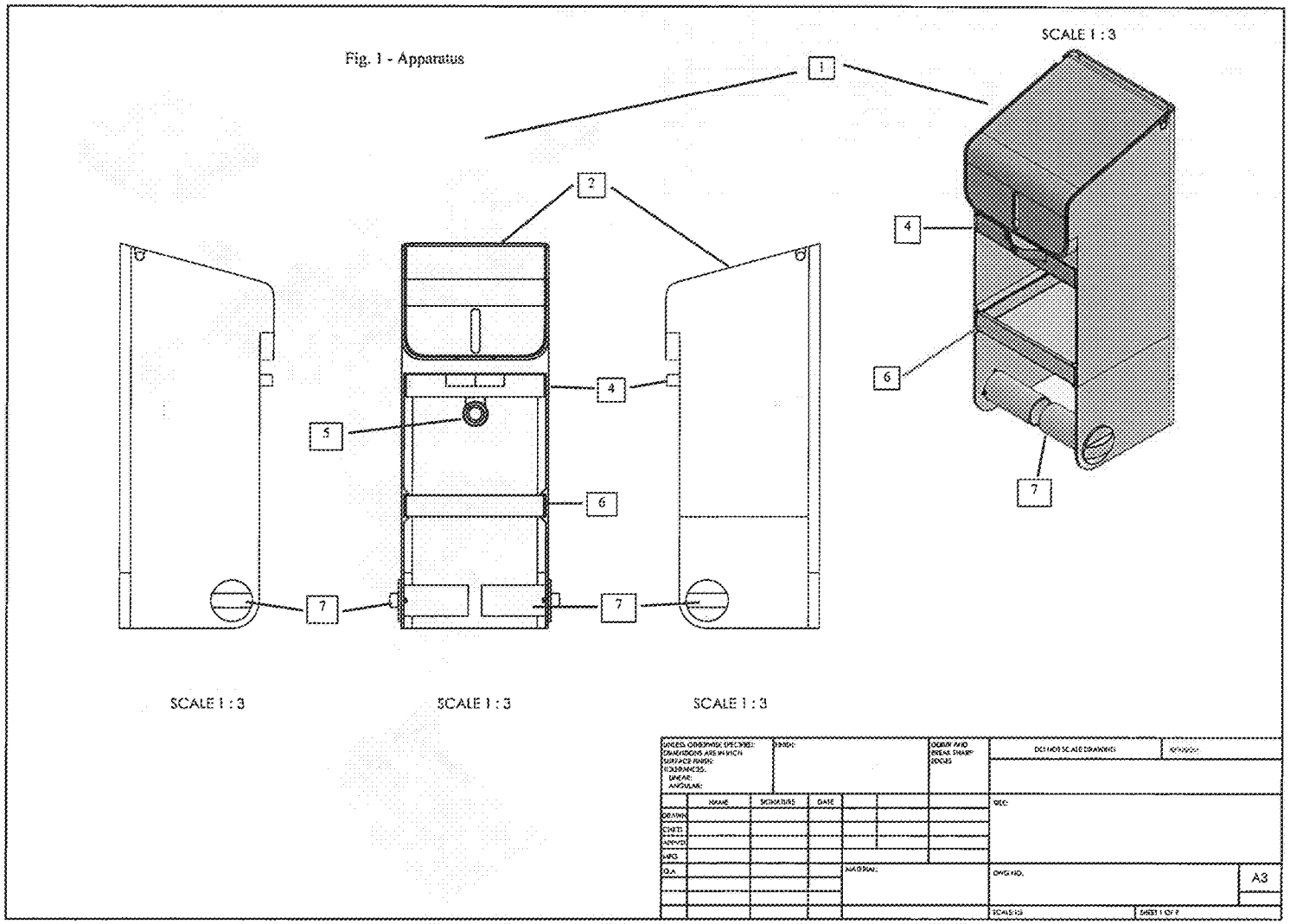
Fig. 1 - Apparatus

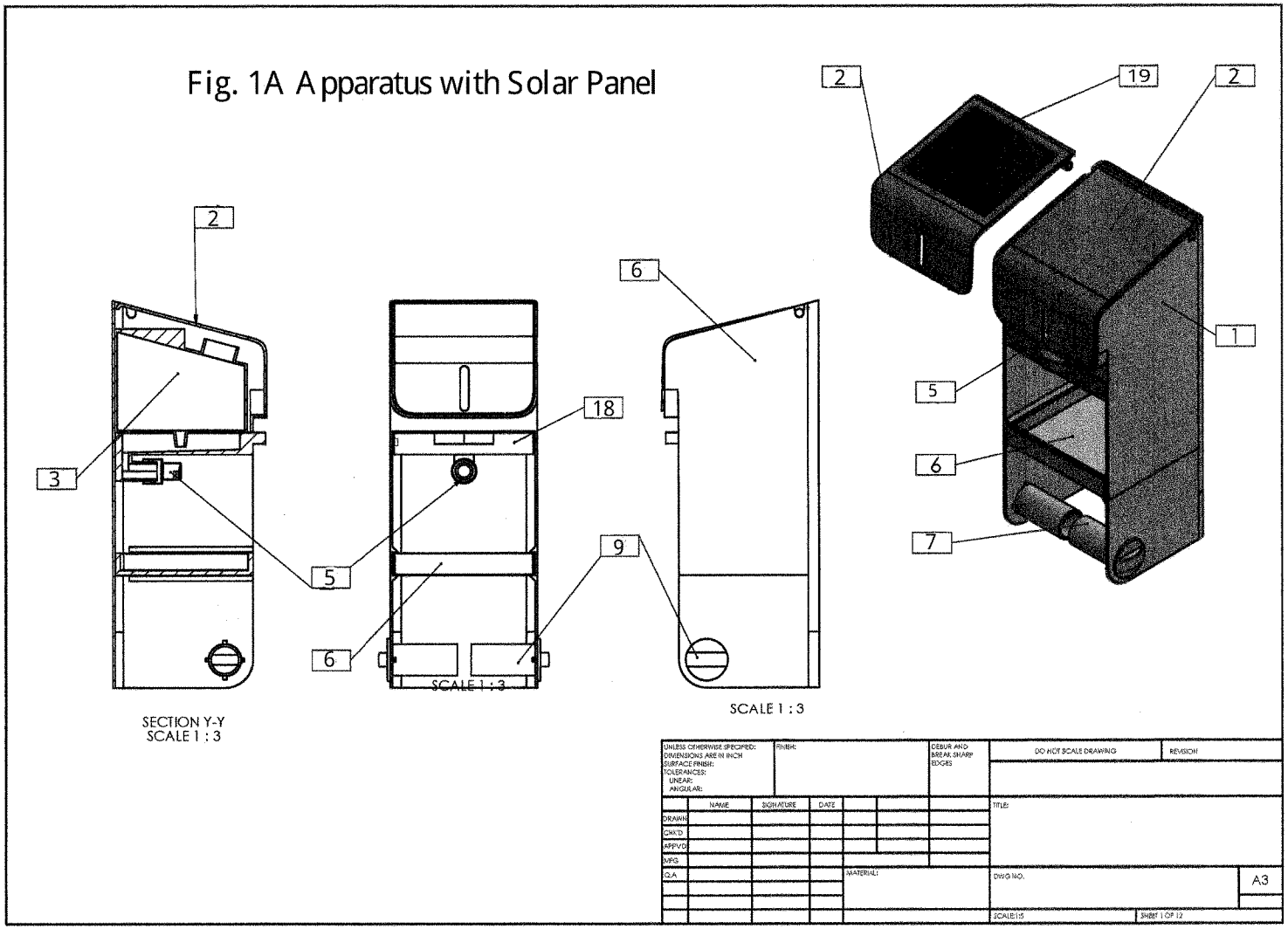
Fig. 1A Apparatus with Solar Panel

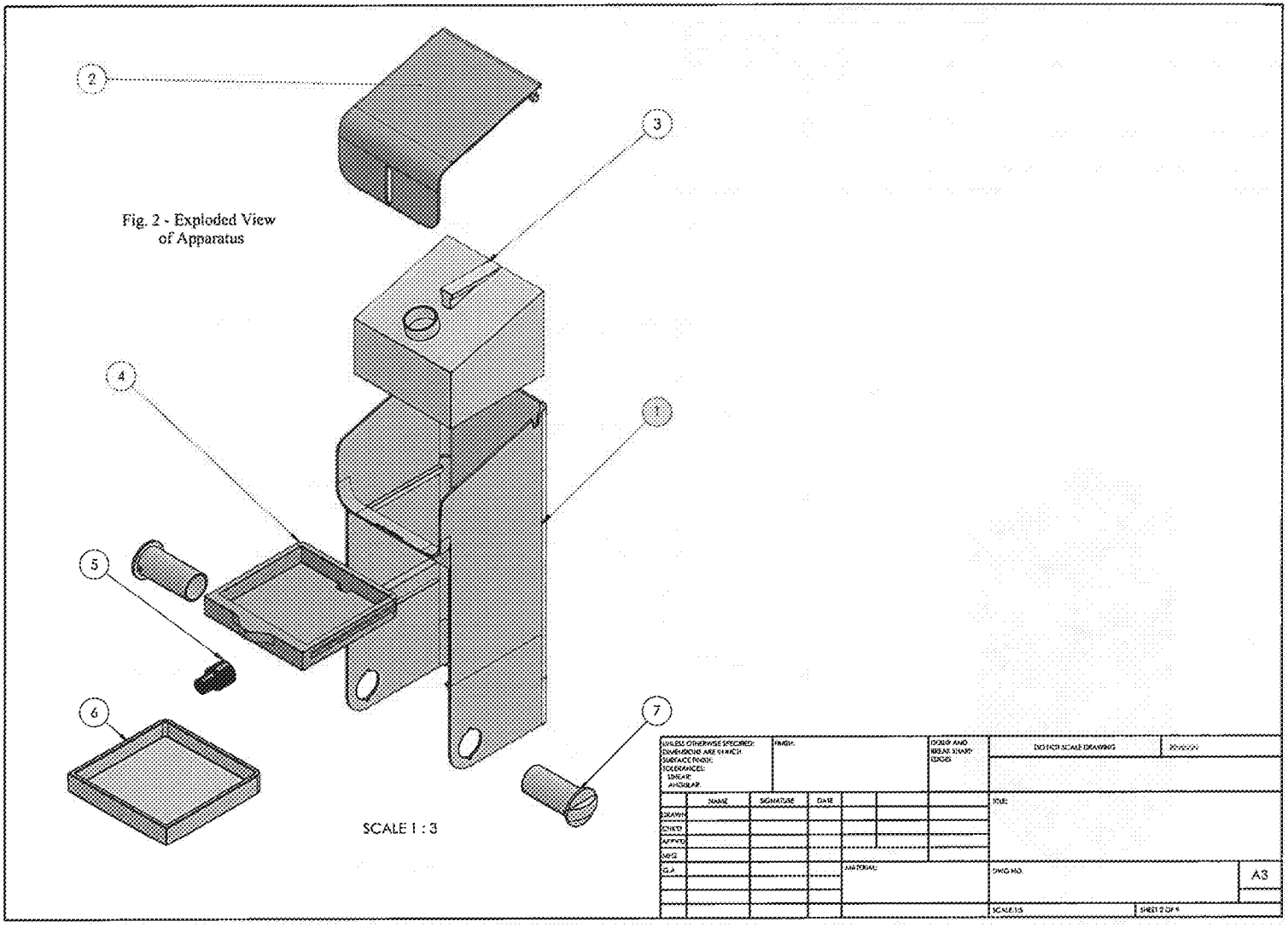
Fig. 2 - Exploded View of Apparatus

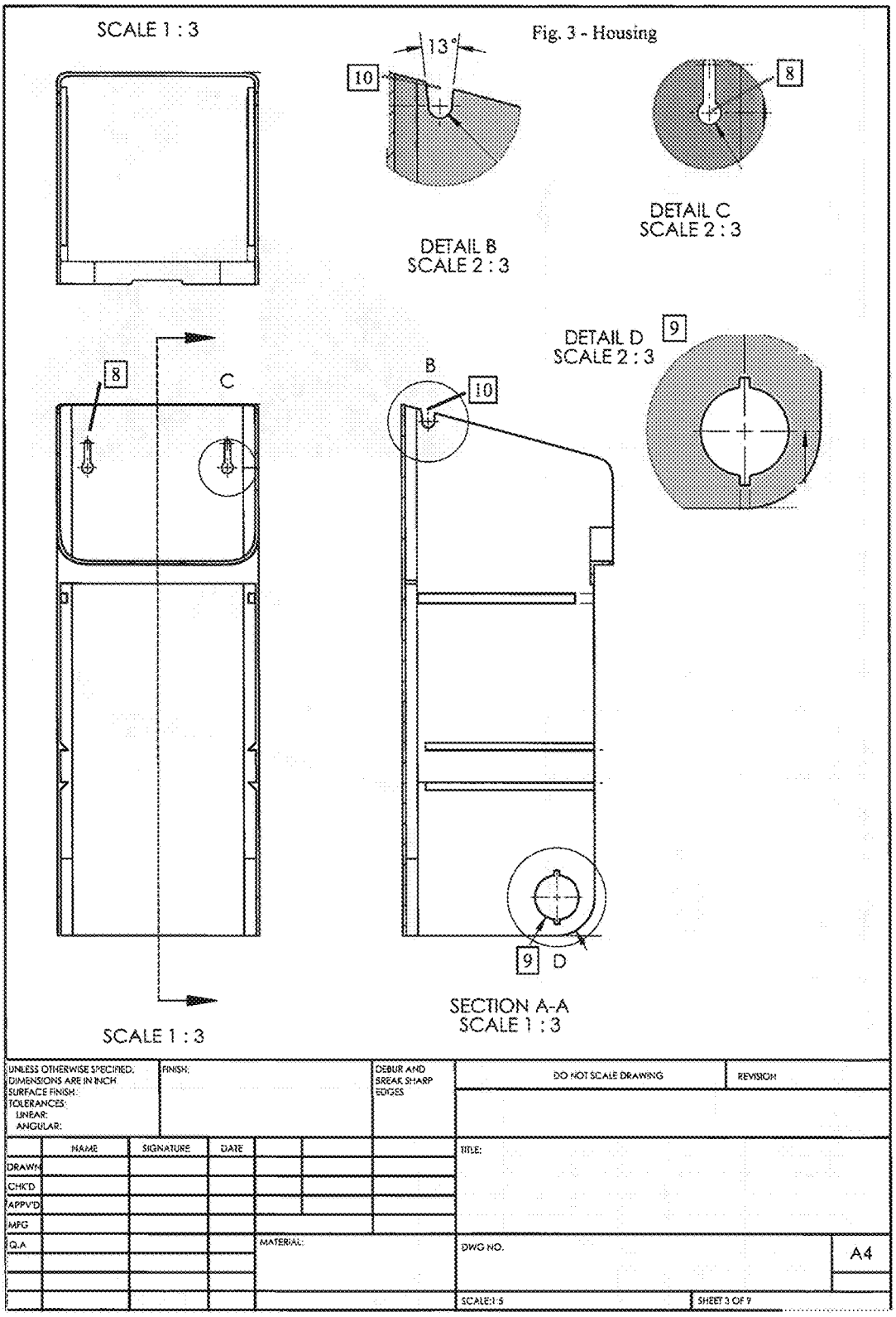
SCALE 1 : 3
Fig. 3 - Housing
13°
10
8
DETAIL B
SCALE 2 : 3
DETAIL C
SCALE 2 : 3
DETAIL D
SCALE 2 : 3
9
8
C
B
10
9
D
SCALE 1 : 3
SECTION A-A
SCALE 1 : 3
UNLESS OTHERWISE SPECIFIED:
DIMENSIONS ARE IN INCH
SURFACE FINISH:
TOLERANCES:
LINEAR:
ANGULAR:
FINISH:
DEBUR AND
BREAK SHARP
EDGES
DO NOT SCALE DRAWING
REVISION
NAME
SIGNATURE
DATE
DRAWN
CHK'D
APPV'D
MFG
Q.A
TITLE:
MATERIAL:
DWG NO.
A4
SCALE:1:5
SHEET 3 OF 9

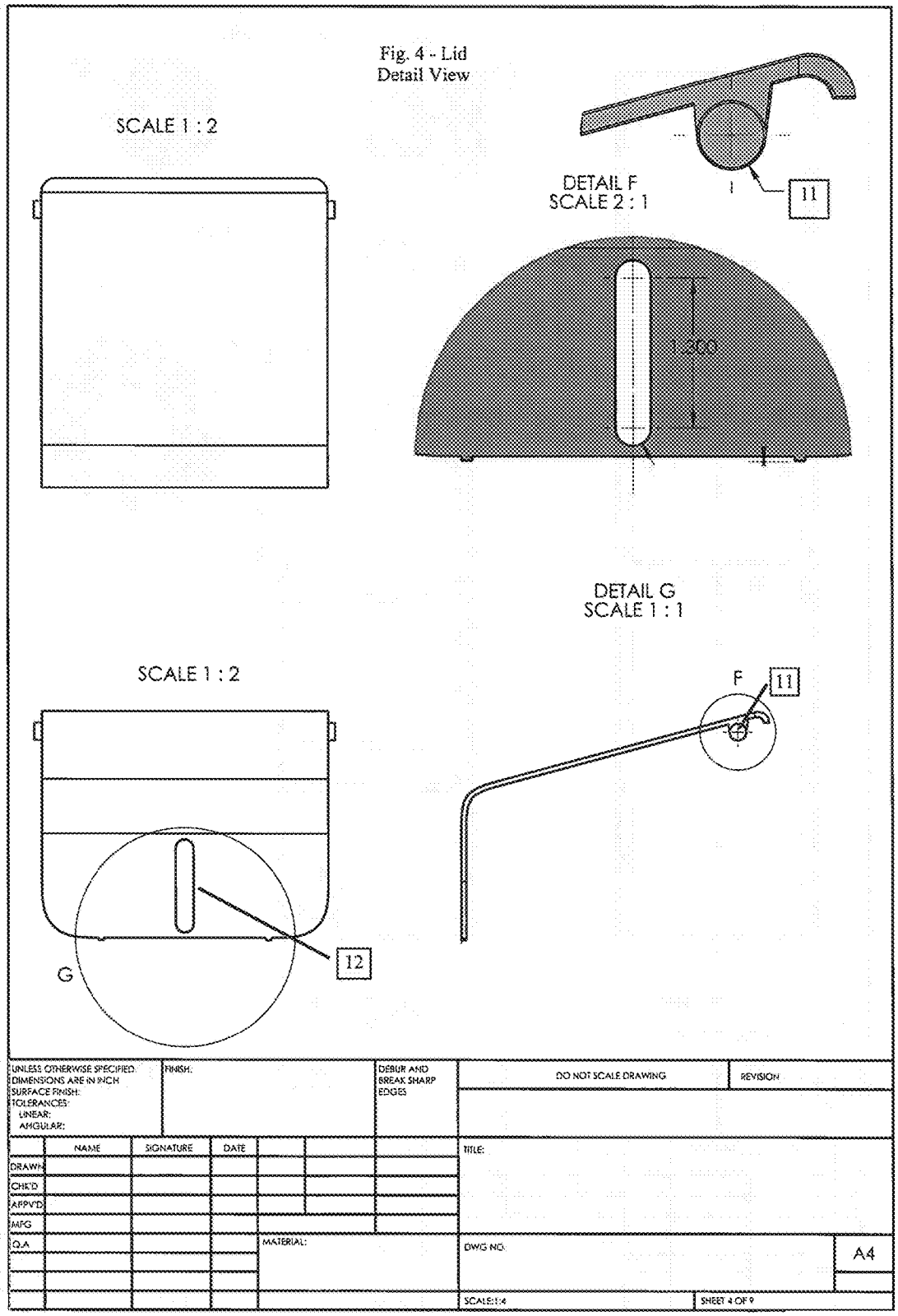
Fig. 4 - Lid
Detail View
SCALE 1 : 2
DETAIL F
SCALE 2 : 1
11
1.200
DETAIL G
SCALE 1 : 1
F
11
SCALE 1 : 2
G
12
UNLESS OTHERWISE SPECIFIED:
DIMENSIONS ARE IN INCH
SURFACE FINISH:
TOLERANCES:
LINEAR:
ANGULAR:
FINISH:
DEBUR AND
BREAK SHARP
EDGES
DO NOT SCALE DRAWING
REVISION
NAME
SIGNATURE
DATE
DRAWN
CHK'D
APPV'D
MFG
Q.A
TITLE:
MATERIAL:
DWG NO.
A4
SCALE:1:4
SHEET 4 OF 9

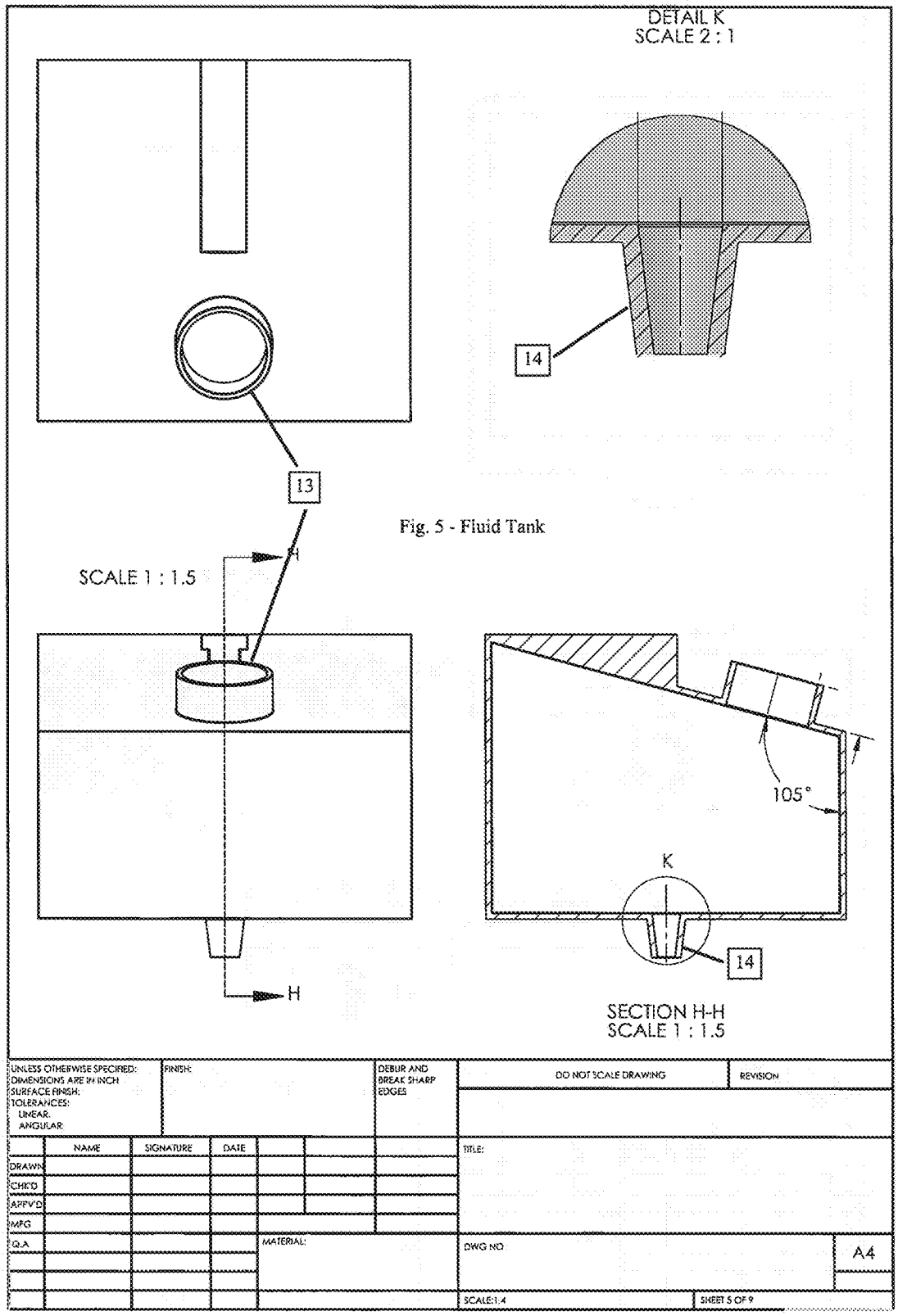
Fig. 5 - Fluid Tank

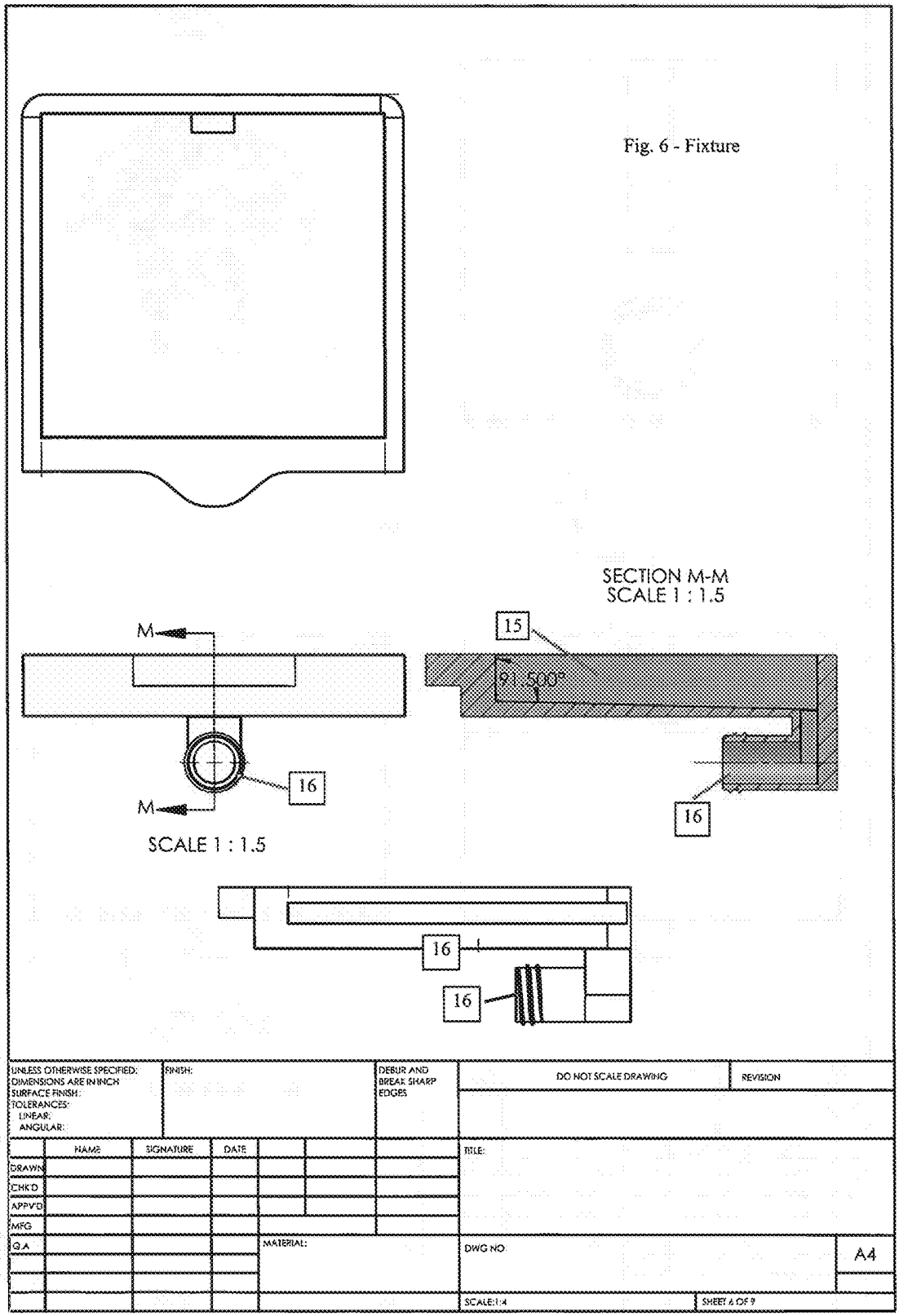
Fig. 6 - Fixture

Catch-Tray
P
SCALE 1 : 1
P
SECTION P-P
SCALE 1 : 1
SCALE 1 : 1
UNLESS OTHERWISE SPECIFIED:
DIMENSIONS ARE IN INCH
SURFACE FINISH:
TOLERANCES:
LINEAR:
ANGULAR:
FINISH:
DEBUR AND
BREAK SHARP
EDGES
DO NOT SCALE DRAWING
REVISION
NAME
SIGNATURE
DATE
DRAWN
CHK'D
APPV'D
MFG
Q.A
MATERIAL:
TITLE:
DWG NO.
A4
SCALE:1:4
SHEET 8 OF 9

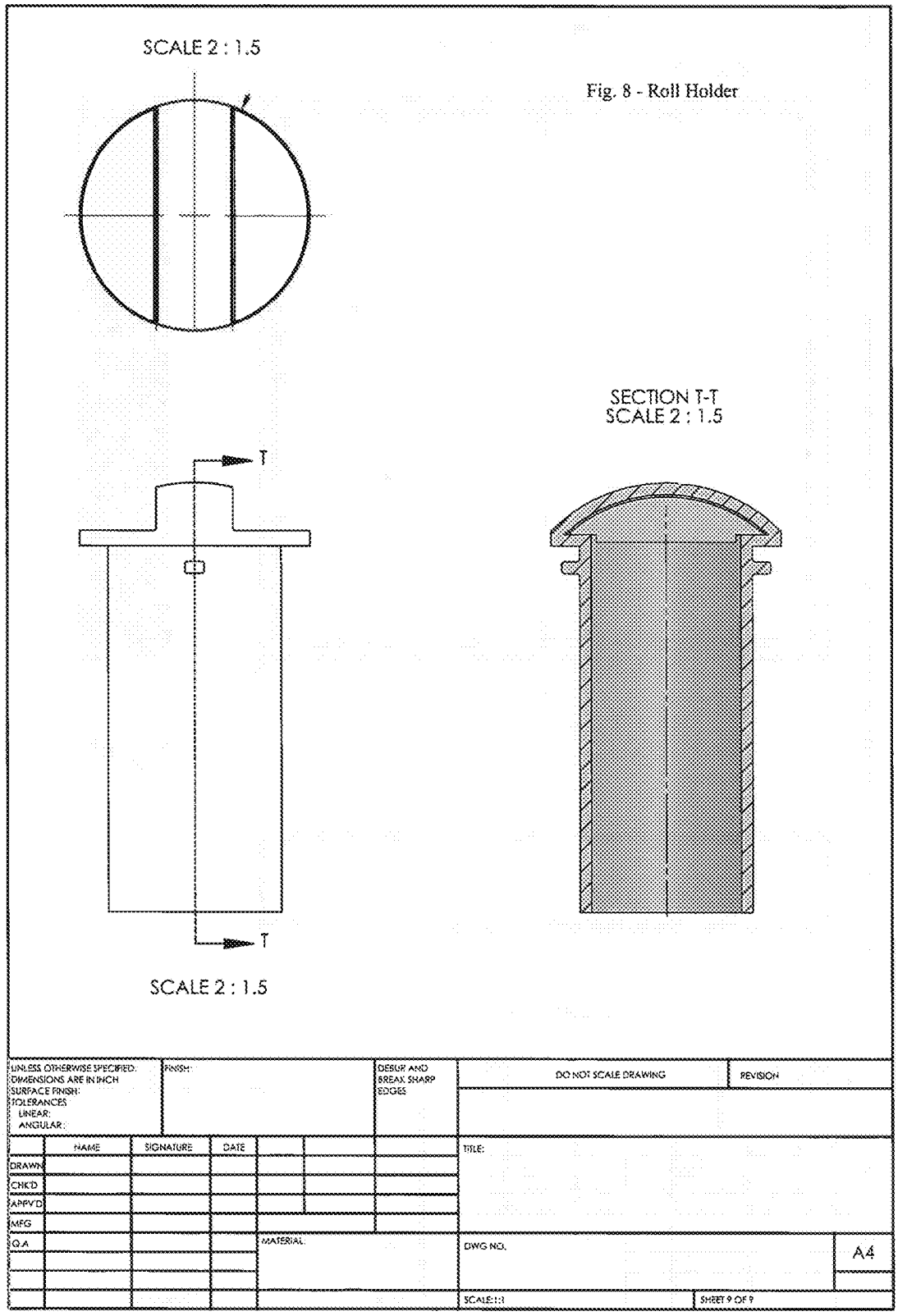
SCALE 2 : 1.5
Fig. 8 - Roll Holder
SECTION T-T
SCALE 2 : 1.5
T
T
SCALE 2 : 1.5
UNLESS OTHERWISE SPECIFIED:
DIMENSIONS ARE IN INCH
SURFACE FINISH:
TOLERANCES
LINEAR:
ANGULAR:
FINISH:
DEBUR AND
BREAK SHARP
EDGES
DO NOT SCALE DRAWING
REVISION
NAME
SIGNATURE
DATE
DRAWN
CHK'D
APPV'D
MFG
Q.A
MATERIAL:
TITLE:
DWG NO.
A4
SCALE:1:1
SHEET 9 OF 9

APPARATUS FOR TOILET PAPER SPRITZER

BACKGROUND

Technical Field

The present invention relates generally to an apparatus for a toilet paper spritzer, and, more specifically, to a scalable dispensing device, a toilet paper spritzer, for use with other components, such as toilet paper or paper towels and any fluid, such as water, witch hazel, scented fluids, medicated fluids, colored fluids, to improve hygiene, comfort, prevent or treat symptoms of genital and anal medical conditions, such as hemorrhoids, yeast infection, and the like.

Related Art

Several methods are known in the art for improved personal hygiene after evacuation and after using regular toilet paper. Clearly, toilet paper alone does not completely or adequately clean the areas involved, and can be abrasive. This ineffective, and many times abrasive, method of cleaning after toilet use can lead to unpleasant odors, and even medical issues. In many other countries outside the United States, a bidet is used. A bidet is a standalone fixture for a bathroom, which is approximately the size of a toilet, and sprays water upward. Installing bidets in residential or commercial homes can be costly due to the cost of the bidet itself and need to install additional plumbing.

Other methods of cleaning, in additional to regular toilet paper, are now becoming more popular, such as pre-moistened bathroom wipes. These pre-moistened wipes can easily dry out if the wipe container is not properly closed between uses. And the wipes are packaged in a folded way that can make them difficult to separate for removing from their container for use. Removing the pre-moistened wipes from their container most often requires using both hands, which can leave germs on the container, causing bacteria, such as *e-Coli* to spread, leading to illness. Once a wipe is successfully removed from its container, and used, then the "biodegradable" wipe can take time to dissolve in water, causing plumbing issues, especially if more than one wipe is required at a time. The alternative to flushing the wipe is to throw the used wipe in a waste basket in the restroom. Obviously, this method would be incredibly unsanitary and cause an odor in the restroom until the waste basket is emptied.

Devices for dispensing fluids for bathroom use are known in the art, in particular for dispensing soap or water at a bathroom sink are more commonly seen in use in public restrooms. Known in the art, but not seen as often, are devices dispensing fluid to toilet paper. Such known devices are those that connect to a toilet and use water from a toilet tank to spray onto toilet tissue, containers that dispense gel, or lotion onto toilet tissue, or combined toilet tissue and fluid dispenser apparatuses. Some apparatuses comprise sponges or disbursing plates, and others include rollers for dispensing fluids on toilet paper. Some apparatuses comprise a nozzles opening upward for a user to press down onto, with the toilet tissue pressing against the nozzle to wet the bottom layers of the tissue. Such devices allow for moistening toilet tissue prior to use and after evacuation, for improved hygiene, and depending upon gel, lotion, or fluid used, can also aid with symptoms of medical conditions and/or odor.

However, attaching valves and an apparatus to a toilet for using water from the toilet can be complicated to install, and while the water from a toilet tank may be clean, water use from a toilet is less desirable by users. In many countries, bidets provide a popular solution to this hygiene problem.

Bidets are a separate apparatus that are for cleaning only, and do not receive waste. Installations of bidets are more costly and require more bathroom space, causing bidets to be less common in the United States. And some of the current methods are not sanitary, since they cause the user to come into contact with either toilet water that may not be sanitary, or the apparatus itself by having the user press onto the apparatus against a sponge, disbursing plate, nozzle, or the like.

In general, there are several problems associated with current methods or devices of dispensing fluid onto toilet paper. Current methods or devices require installation onto a toilet for using toilet tank or bowl water, or require installation of a combination toilet paper dispenser and fluid dispenser. In both cases, the expense associated with these current methods can be extensive.

Many other problems and disadvantages associated with prior devices or methods will become apparent to one of skill in the art upon review of such prior devices or methods and in light of the teachings herein.

SUMMARY OF THE INVENTION

Various aspects of the present invention can be found in an apparatus and method for toilet paper spritzer, and, more specifically, to a scalable dispensing device, a toilet paper spritzer, for use with other components, such as toilet paper or paper towels and any fluid, to improve hygiene and/or address genital and/or anal concerns.

Generally, a toilet paper spritzer device is similar in dimensions to a commercial (two standard roll, stacked) toilet paper dispenser. In one embodiment, the toilet paper spritzer device is approximately five inches wide and ten to twenty inches tall, in one embodiment specifically fourteen inches, depending on the model and its capabilities. The device features a housing that secures to a stall or wall, near a toilet. The device works in conjunction with, or replaces, an existing toilet paper dispenser. Housed inside the housing are: (a) a removable, refillable water tank; (b) a dispenser comprised of a small reservoir, a removable pump mechanism, a removable spray nozzle, and (c) a catch tray. This dispenser is removable, easily slides into the housing, and can be removed for easy cleaning. The dispenser features a large push button to operate manually the water/fluid pumps. The catch tray is also removable for emptying excess fluids and cleaning. Below the roll, a toilet paper roll holder can optionally reside, capable of holding either a single or double roll of toilet paper.

In one embodiment having a manual pump, in practice, a user will remove the toilet paper from the toilet paper roll, then hold the toilet paper, folded and ready to use, in the spray well. The user will then press the spray pump button, which will spray water onto the toilet paper, moistening the toilet paper.

In another embodiment, the user will turn a dial to select a particular fluid or combination of fluids for dispensing before depressing the spray pump button.

In another embodiment, a battery powered spray activation system having heat or motion sensors activates the pump mechanism for "touch-less" spray activation. In an embodiment having an automatic activation system, the pump activation mechanism can be either battery powered, solar powered, or a combination of battery and solar powered. The solar powered mechanism can power itself using either ambient light or sunlight, or a combination of both ambient light and sunlight.

In one embodiment with either an automatic or manual pump activation system, a user can vary an amount of fluid to be dispensed. The fluid for dispensing can be clear or have a variety of colors. The fluid can be water, a scented fluid, or a medicated fluid, either organic/natural (such as witch hazel) or over the counter fluid (such as a hemorrhoid medication, or a medication for improved hygiene or itchiness of a genital area, such as for jock itch in men, or a yeast infection prevention or treatment of symptom medication for women). Separate dispensers for men and women can be designed (i.e., a pink dispenser for women's public restrooms having women-specific products, and a blue dispenser for men's public restrooms containing products specific for men). When using fluids in addition to or instead of water, in another embodiment, a dispenser can hold both types of fluids. In one embodiment, a fluid dispenser can contain more than one chamber for holding more than one type of fluid. A user can dial to a desired fluid, having a choice from more than one fluid, such as water, a freshener fluid, or a hemorrhoid medication.

The toilet paper spritzer device can be installed easily with a common wall mounting system. While one embodiment anticipates a device size of approximately five inches wide and ten to twenty inches tall, it is understood that the device can be scalable for various uses, such as a smaller size for residential, and a larger size for commercial (such as corporate offices, hotel rooms, government buildings, event centers, schools and universities, port-o-potties, and the like).

In an alternate embodiment, the spritzer device can be used with paper towels for application in a kitchen or bathroom for use with a disinfecting fluid or some other cleaning fluid. Such a device could be modified to hold paper towels, and mounted onto a wall near a sink or some other area where paper towels are commonly used or needed.

Many other aspects and variations of the toilet paper spritzer device of the present invention can be appreciated by one of skill in the art through review of the detailed description, and corresponding drawings.

BRIEF DESCRIPTION OF THE DIAGRAMS

The numerous objects and advantages of the present invention may be better understood by those skilled in the art by reference to the accompanying figures in which:

FIG. 1 shows an overview of the apparatus;

FIG. 2 shows an exploded view of the apparatus;

FIG. 3 shows a housing;

FIG. 4 shows a detailed view of a portion of the housing;

FIG. 5 shows a fluid tank;

FIG. 6 shows a dispenser with a pool and pump and nozzle spout;

FIG. 8 shows a detailed view of the roll holder.

FIG. 1A shows an alternative embodiment of the apparatus with a solar panel.

DETAILED DESCRIPTION OF THE DIAGRAMS

Figure 7:
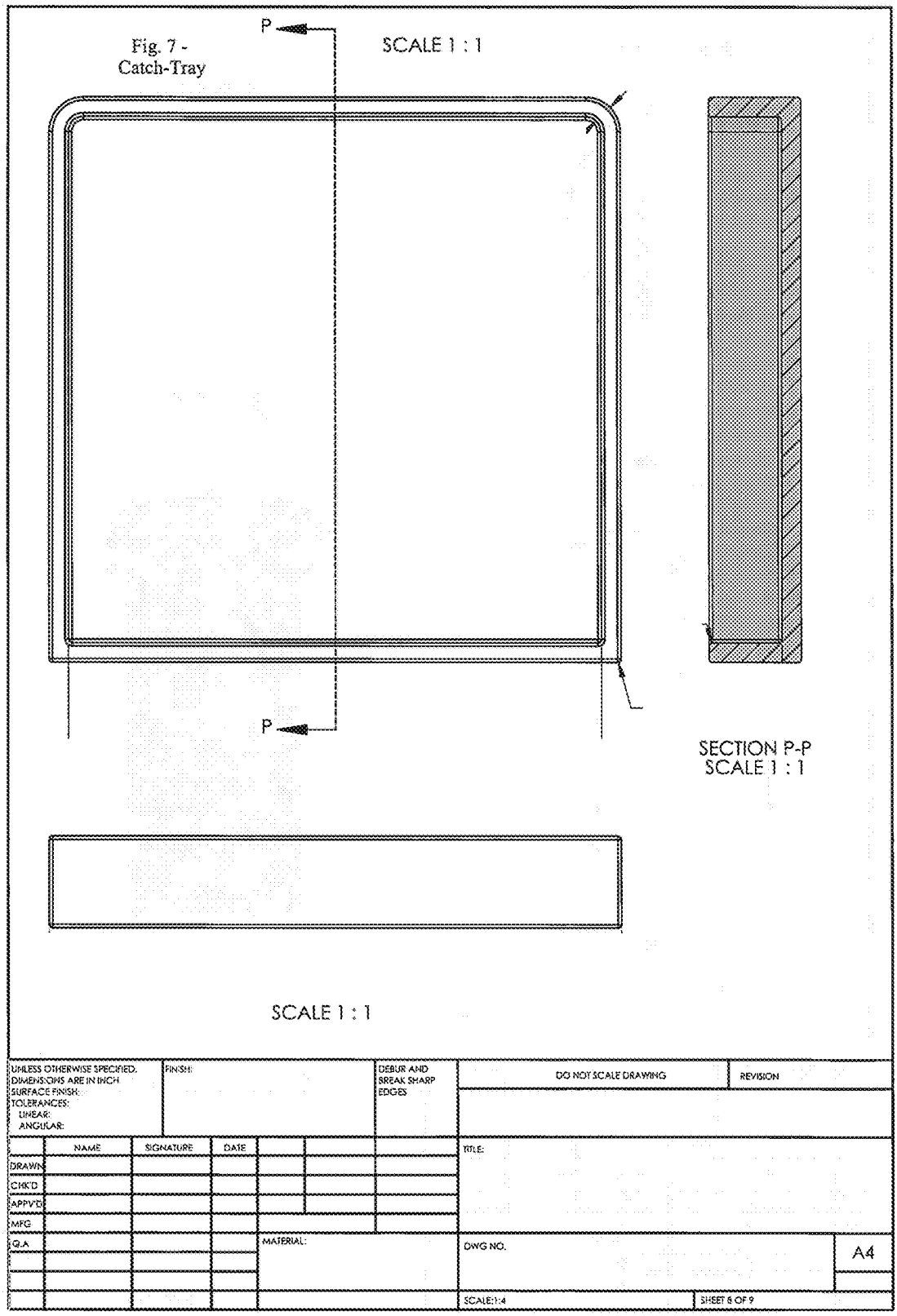
FIG. 7 shows a catch tray.

FIG. 1 shows an overview of the apparatus. As shown, the apparatus comprises a housing [1] with a hinged or removable lid [2], a removable fluid tank [(FIG. 2) 3] that fits under the lid [2] and into the dispenser for the spritz device [4]. The dispenser [4] has a small reserve pool for readily available fluids for dispensing and threads for fixing a spray or spritz pump nozzle device [5]. The housing also comprises a catch-tray [6] below the pump mechanism and nozzle to catch excess dispensed fluid. The housing further comprises a toilet paper roll holder [7].

FIG. 2 shows an exploded view of the apparatus more clearly demonstrating the relative dimensions of the housing [1], lid [2], fluid tank [3], dispenser [4] with nozzle [5], catch-tray [6] and roll holder [7].

FIG. 3 shows a detailed view of the housing [1]. The housing has cutouts for mounting onto stalls or walls [8] as well as cut-outs [9] to receive the toilet paper roll holder. Grooves [10] allow for securing the lid [2] as well as allowing the lid [2] to rotate up for replacing or refilling the fluid tank [3].

FIG. 4 shows a detailed view of the lid. The lid has brackets or a rod [11] to fit into the grooves [10] for opening or removing the lid. The lid has a long and narrow cut-out [12] on the front portion of the lid so that a one can view the fluid level in the fluid tank [3]. This assists one in determining when to refill the fluid tank. When a bifurcated tank is used, two cut-outs [12] are utilized so that each portion of the tank may be viewed for inventory level.

FIG. 5 shows a detailed view of the fluid tank. The fluid tank has a top opening [13] for receiving fluid and a tapered bottom opening [14] for delivering fluid into the pump mechanism [4]. When a bifurcated tank is used, there is a dividing wall and top openings [13] and bottom openings [14] for each section.

FIG. 6 shows the dispenser for the pump and spritz mechanism. The dispenser slides into and out of the housing [1] for easy cleaning and adjustment. The dispenser contains a small reserve water or fluid pool [15] that feeds to a threaded male spout [16] to accept a pump and spray or spritz nozzle. In one embodiment, when the fluid tank is bifurcated, depending on the fluid, the fluids could mix in the pool to deliver a mixed fluid spritz. In another embodiment, the pool [15] and spout [16] are continuously bifurcated for selection by the user in a double nozzle configuration to maintain turgor pressure.

FIG. 7 shows a detailed view of the catch-try. The purpose of the catch-try is to catch extraneously dispense of fluid and protect the roll of toilet paper from unwanted spritzing. The catch-try is removable for disposal of extraneous fluid and for cleaning.

FIG. 8 shows a detailed view of the roll holder. The roll holder can be continuous, spring-loaded for compression or, as shown in this embodiment, bifurcated such that mirror roll holders are inserted into each of the housing cut-outs [9].

FIG. 1A shows an alternative embodiment of the apparatus with a solar panel or film [19]. The solar panel or film is connected to the dispenser [5] via wiring [18] in the housing [1]. When the dispenser [5] is set completely within the housing [1] the contacts of the dispenser and wiring align and connect to transfer power from the solar panel to the spritz mechanism [5].

Although an apparatus according to the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by this disclosure and appended diagrams.

The invention claimed is:

1. A toilet paper spritzing apparatus comprising:

a wall-mountable housing unit capable of housing in a vertical arrangement a tank, a dispenser positioned below said tank, a tray positioned below said dispenser, a toilet paper roll holder with toilet paper roll positioned below said tray, wherein said housing unit has a lid on a hinge for removal of or refilling of said tank and wherein said housing unit has a slit or window for viewing a current volume of fluids of said tank, and wherein said housing unit contains internal ledges for integration of said tank, said dispenser and said tray, and grooves for acceptance of lips of said toilet paper holder;

said tank of such dimensions that is capable of sitting completely inside said housing unit braced upon said internal ledges within said housing unit but otherwise not being affixed to said housing unit, wherein said tank has an opening on the top and a tapered bottom opening;

said dispenser including of a sloped reservoir, pump mechanism and spray nozzle wherein said fluids are dispensed from said tank through said tank bottom opening through said dispenser downward into an open space of dimensions capable of accommodating the extremity portion of a human hand holding two or more squares of toilet paper, wherein said dispenser fits within said housing unit resting on said internal ledges, said internal ledges capable of being removed perpendicularly from said housing unit;

said tray located below said dispenser within said housing unit, wherein said tray is capable of being removed perpendicularly from said housing unit by manually sliding along said internal ledges internal to the housing unit; and said toilet paper roll holder.

2. The apparatus of claim 1, wherein said tank is bifurcated, said bifurcated tank including a dial and valve system wherein said dial and valve system permits only one side of said bifurcated tank to release said fluids into said dispenser or both sides of said bifurcated tank to release said fluids into said dispenser depending on the position of said dial.

3. The apparatus of claim 1, wherein said tank is bifurcated and said dispenser is bifurcated, said bifurcation continuous so as to preserve turgor pressure when said tank contains said fluids.

4. The apparatus of claim 1, wherein said fluid comprises at least one of water, water containing anti-inflammatory medications, water containing anti-fungal medications, water containing anti-bacteria medications or witch hazel.

5. The apparatus of claim 1, wherein said pump mechanism is manually actuated.

6. The apparatus of claim 1, wherein said pump mechanism is electrically actuated, said electrically actuated pump mechanism comprising a touch sensor or proximity sensor comprising either a heat sensor or light sensor.

7. The apparatus of claim 6, wherein an energy source for said electrically actuated pump mechanism is a battery affixed to said dispenser.

8. The apparatus of claim 6, wherein an energy source for said electrically actuated pump mechanism is a solar panel affixed to said lid of said housing unit, wherein wiring from said solar panel is embedded in said housing unit, traverses internally of said housing unit to said internal ledges for said dispenser such that when said dispenser is in said housing unit said electrically actuated pump mechanism is in contact with said wiring.

9. The apparatus of claim 1, said roll holder including two rods, each rod inserted perpendicularly to said housing unit, wherein an end cap of each rod further comprises lips internally to said end cap and a tab protrusion externally to said end cap, and wherein said tab protrusion rotates the rods so that said lips can lock each said rod into said housing unit once inserted within a toilet paper roll.

10. The apparatus of claim 1, wherein said tank is a bifurcated tank, said bifurcated tank including a dial and a valve system, said valve system configured to permit one side of said bifurcated tank to release fluid into said dispenser when the dial is in a first position and both sides of said bifurcated tank to release fluid into said dispenser when the dial is in a first position when said dial is in a second position.

11. The apparatus of claim 1, wherein:

said tank is a bifurcated tank, said bifurcated tank including a dial and a valve system, said valve system configured to permit one side of said bifurcated tank to release fluid into said dispenser when the dial is in a first position and both sides of said bifurcated tank to release fluid into said dispenser when the dial is in a first position when said dial is in a second position;

said dispenser is a bifurcated dispenser and configured to preserve turgor pressure when said bifurcated tank contains said fluids; and said housing unit contains two slits for viewing the volume levels of each side of said bifurcated tank.

12. The apparatus of claim 11, wherein said fluids are scented.

13. The apparatus of claim 11, wherein said fluids are colored.

14. The apparatus of claims 2, wherein said pump mechanism is manually actuated.

15. The apparatus of claim 6, wherein an energy source for said electrically actuated pump mechanism is a solar panel.

16. The apparatus of claim 1, wherein said tank is a bifurcated tank including a valve system, wherein said valve system permits only one side of said bifurcated tank to release said fluids into said dispenser.

17. The apparatus of claim 1, wherein said tank is a bifurcated tank including a dial, wherein said dial is configured to control release of said fluids into said dispenser.

18. The apparatus of claim 1, wherein said pump mechanism is electrically actuated.

* * * * *